US011382367B2

(12) United States Patent
Myerscough et al.

(10) Patent No.: US 11,382,367 B2
(45) Date of Patent: Jul. 12, 2022

(54) OUTDOOR ACTIVITY SUIT

(71) Applicant: Mustang Survival Corp., Burnaby (CA)

(72) Inventors: Richard Kerr Myerscough, Victoria (CA); Ross Davis Harrington, Victoria (CA)

(73) Assignee: Mustang Survival Corp., Burnaby (CA)

( * ) Notice: Subject to any disclaimer, the term of this patent is extended or adjusted under 35 U.S.C. 154(b) by 521 days.

(21) Appl. No.: 15/540,669

(22) PCT Filed: Dec. 18, 2015

(86) PCT No.: PCT/CA2015/051349

§ 371 (c)(1),
(2) Date: Jun. 29, 2017

(87) PCT Pub. No.: WO2016/106449

PCT Pub. Date: Jul. 7, 2016

(65) Prior Publication Data

US 2017/0360119 A1 Dec. 21, 2017

Related U.S. Application Data

(60) Provisional application No. 62/098,370, filed on Dec. 31, 2014.

(51) Int. Cl.

| | |
|---|---|
| ***A41D 13/002*** | (2006.01) |
| ***A41D 13/00*** | (2006.01) |
| ***A41D 13/05*** | (2006.01) |

(52) U.S. Cl.

CPC ..... *A41D 13/002* (2013.01); *A41D 13/0002* (2013.01); *A41D 13/0525* (2013.01); *A41D 2300/322* (2013.01)

(58) Field of Classification Search

CPC ..... A41D 13/002; A41D 13/0525; A41D 13/0002; A41D 2300/322; A41D 3/00;
(Continued)

(56) References Cited

U.S. PATENT DOCUMENTS 3,493,972 A * 2/1970 Oldham ..... B63C 9/087 2/2.17
4,862,517 A * 9/1989 Meistrell ..... B63C 11/04 2/2.17

(Continued)

FOREIGN PATENT DOCUMENTS

CA 2 146 937 A1 10/1996
CA 2 301 754 A1 9/2001

(Continued)

OTHER PUBLICATIONS

International Search Report Corresponding to PCT/CA2015/051349 dated Mar. 8, 2016.

(Continued)

*Primary Examiner* — Khoa D Huynh
*Assistant Examiner* — Aiying Zhao
(74) *Attorney, Agent, or Firm* — Taft Stettinius & Hollister LLP

(57) ABSTRACT

An outdoor activity suit includes a body having a front portion, a back portion, opposed sides where the front portion connects to the back portion, a neck receiving portion, an arms receiving portion and a legs receiving portion. The front portion, the neck receiving portion and the legs receiving portion of the body form a first component of the body. The back portion and the arms receiving portion form a second component of the body. An endless loop zipper connects the first component and the second component such that the second component is selectively removable from the first component.

10 Claims, 21 Drawing Sheets

(58) Field of Classification Search
CPC ..... A41D 3/02; A41D 13/012; B63C 11/04; B63C 2011/043; B63C 2011/046
USPC ..... 2/69, 70, 82, 85, 87, DIG. 5
See application file for complete search history.

(56) References Cited

U.S. PATENT DOCUMENTS

| | | | | |
|---|---|---|---|---|
| 5,940,879 | A | 8/1999 | Whitehouse | |
| 6,415,449 | B2 * | 7/2002 | Duplock | A41D 13/012 2/275 |
| 6,427,620 | B1 | 8/2002 | Crawford | |
| 2007/0277278 | A1 * | 12/2007 | O'Brien | B63C 9/087 2/2.17 |
| 2009/0100557 | A1 * | 4/2009 | Insulan | A41D 13/012 2/2.17 |
| 2012/0073028 | A1 * | 3/2012 | Knopik | A41D 13/0017 2/79 |
| 2014/0325734 | A1 | 11/2014 | Kuelker | |

FOREIGN PATENT DOCUMENTS

| | | | | |
|---|---|---|---|---|
| CA | 2 620 258 | A1 | 3/2007 | |
| CA | 2 759 337 | A1 | 11/2010 | |
| CA | 2 840 241 | A1 | 1/2013 | |
| DE | 2519696 | A1 * | 11/1976 | A41D 13/02 |
| WO | 2013/001413 | A1 | 1/2013 | |
| WO | WO-2013001413 | A1 * | 1/2013 | A41D 13/012 |

OTHER PUBLICATIONS

Written Opinion Corresponding to PCT/CA2015/051349 dated Mar. 8, 2016.
International Preliminary Report on Patentability Corresponding to PCT/CA2015/051349 dated Mar. 22, 2017.

* cited by examiner

OUTDOOR ACTIVITY SUIT

FIELD

There is described a suit that was originally designed as an immersion suit for water sports. It has become apparent that, if made out of suitable materials, the suit would also be suitable for snowmobiling and a range of other outdoor activities.

BACKGROUND

A common problem encountered with outdoor activity suits is that of over-heating. Published International Patent Application WO2013/0001413 (Myerscough) discloses a previous approach that has been used to address this problem with dry suits.

SUMMARY

There is provided an outdoor activity suit which includes a body having a front portion, a back portion, opposed sides where the front portion connects to the back portion, a neck receiving portion, an arms receiving portion and a legs receiving portion. The front portion, the neck receiving portion and the legs receiving portion of the body form a first component of the body. The back portion and the arms receiving portion form a second component of the body. An endless loop fastener connects the first component and the second component, such that the second component is selectively removable from the first component.

There are two possible positions for the endless loop fastener. A first position for the endless loop fastener is across the back adjacent to the neck receiving portion, down the opposed sides along the front portion and across the back adjacent to the leg receiving portion. A second position for the endless loop fastener is across the front portion of the body adjacent to the neck receiving portion, down the opposed sides of the body along the rear portion and across the front portion adjacent to the leg receiving portion.

As will hereinafter be described, a first embodiment of outdoor activity suit allows for both a top entry and a bottom entry into the suit. In order to provide some relief from heat, the second component can be removed and the first component worn alone.

As will hereinafter be further described, the preferred endless loop fastener is a zipper. A dry zipper is preferred as this is the best form of fastener for the original intended application of immersion suits for water sports. It will be understood that there are other types of fasteners that could be used, depending upon the intended application. Alternative fasteners include "zip-lock" type fasteners such as presently used on sandwich bags, hook and loop tape fastener commonly known by the Trademark VELCRO, magnets.

Another problem encountered with outdoor activity suits is the need to remove the suit in order to defecate. It is preferred that the endless loop zipper have multiple sliders to facilitate opening selected portions of the endless loop zipper. This enables the bottom entry to be opened to facilitate defecating while wearing the suit and enables an access opening to be formed to facilitate male urination.

In a second embodiment of outdoor activity suit, the second component includes wrap around torso flaps which create an overlying jacket. This enables the second component to be worn alone as a jacket.

There will hereafter be described variations and modification that can be made to the outdoor activity suit to address particular applications.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
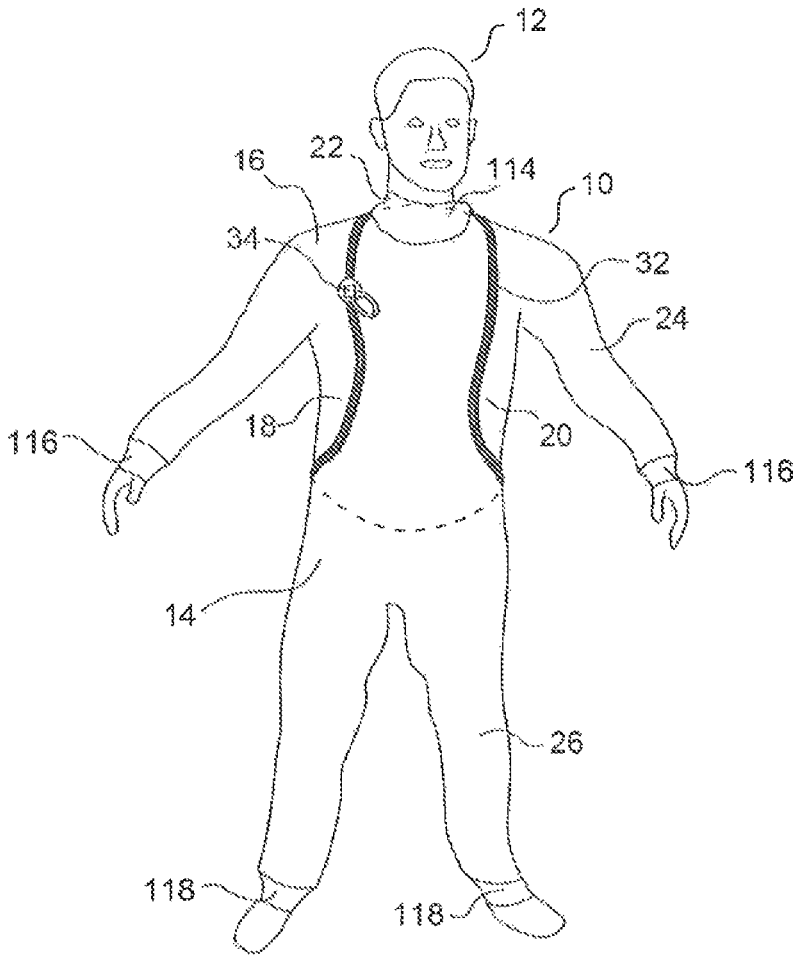
FIG. 1 is a front elevation view of a first embodiment of outdoor activity suit.

A first embodiment of outdoor activity suit, generally identified by reference numeral 10, will be described with reference to FIG. 1 through 10. A second embodiment of outdoor activity suit, generally identified by reference numeral 100, will be described with reference to FIG. 11 through 16.

Structure and Relationship of Parts of the First Embodiment 10

Figure 2:
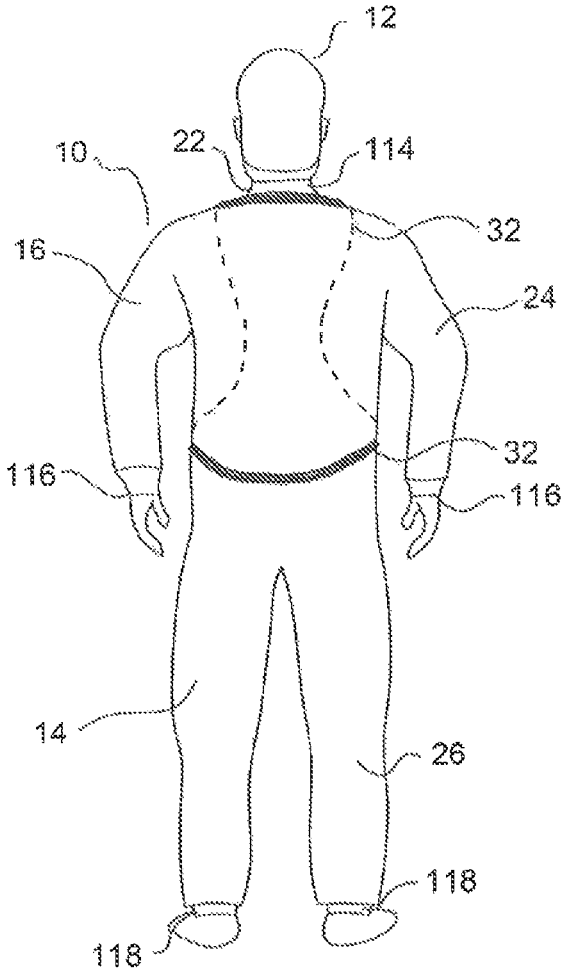
FIG. 2 is a rear elevation view of the first embodiment of outdoor activity suit illustrated in FIG. 1.
Figure 3:
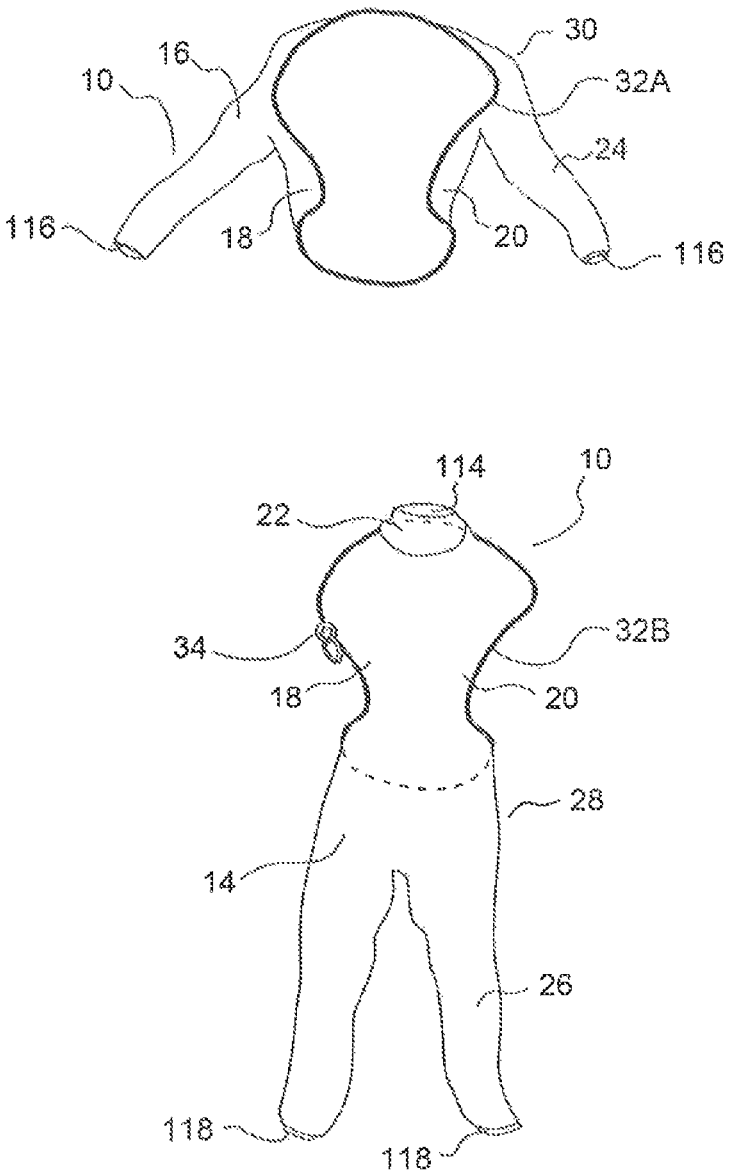
FIG. 3 is an explored from elevation view of the first embodiment of outdoor activity suit illustrated in FIG. 1, with the second component separated from the first component.

Referring to FIG. 1 and FIG. 2, outdoor activity suit 10 includes a body 12. For the purpose of orientation for the description which follows, body 12 can be said to have a front portion 14, a back portion 16, and opposed sides 18 and 20 where front portion 14 connects to back portion 16. There is a neck receiving portion 22, an arms receiving portion 24 and a legs receiving portion 26. Referring to FIG. 3, front portion 14, neck receiving portion 22 and legs receiving portion 26 of body 12, collectively form a first component 28 of body 12. Referring to FIG. 3, back portion 16 and arms receiving portion 24 of body 12, collectively form a second component 30 of body 12.

Referring to FIG. 1 through FIG. 3, an endless loop fastener 32 connects first component 28 and second component 30. Referring to FIG. 2, endless loop fastener 32 is positioned across back portion 16 of body 12 adjacent to neck receiving portion 22. Referring to FIG. 1, endless loop fastener 32 extends down opposed sides 18 and 20 of body 12 along front portion 14. Referring to FIG. 2, endless loop fastener 32 extends across back portion 16 adjacent to leg receiving portion 26. Referring to FIG. 3, endless loop fastener 32 has two mating portions 32A and 32B, when these mating portions 32A and 32B are separated, second component 30 becomes selectively removable from first component 28.

Depending upon the application, there are different endless loop fasteners that can be used. When intended for use as an immersion suit for water sport activities, the endless loop fastener which is preferred is a dry zipper. It is preferred that the endless loop zipper have multiple sliders 34, however a single slider would still be adequate, to facilitate opening selected portions of the endless loop zipper, as will hereinafter be further described in relation to operation.

Variations

Referring to FIG. 11 through 16, there is illustrated outdoor activity suit 100. Outdoor activity suit 100 has the same structure and same component elements as outdoor activity suit 10. For that reason, the same reference numerals used to identify component elements of outdoor activity suit 10 will be used to identify the identical components of outdoor activity suit 100. The focus of this description of variations will, therefore, be upon features that outdoor activity suit 100 has that were not included in outdoor activity suit 10.

Figure 11:
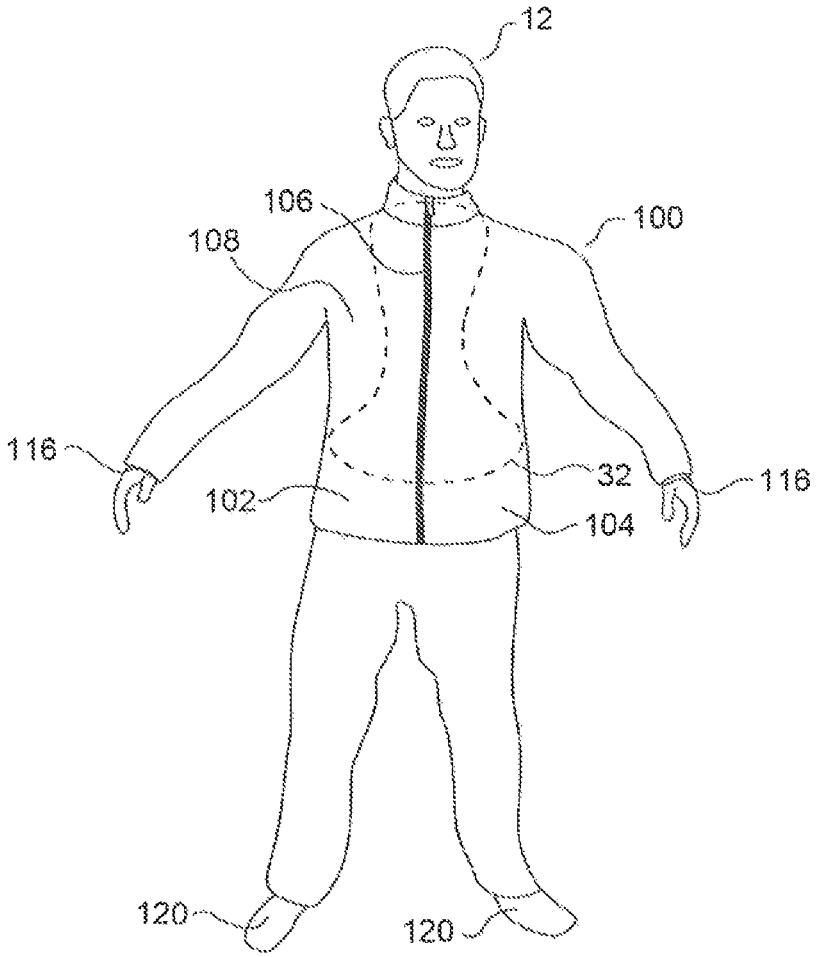
FIG. 11 is a front elevation view of a second embodiment of outdoor activity suit.
Figure 12:
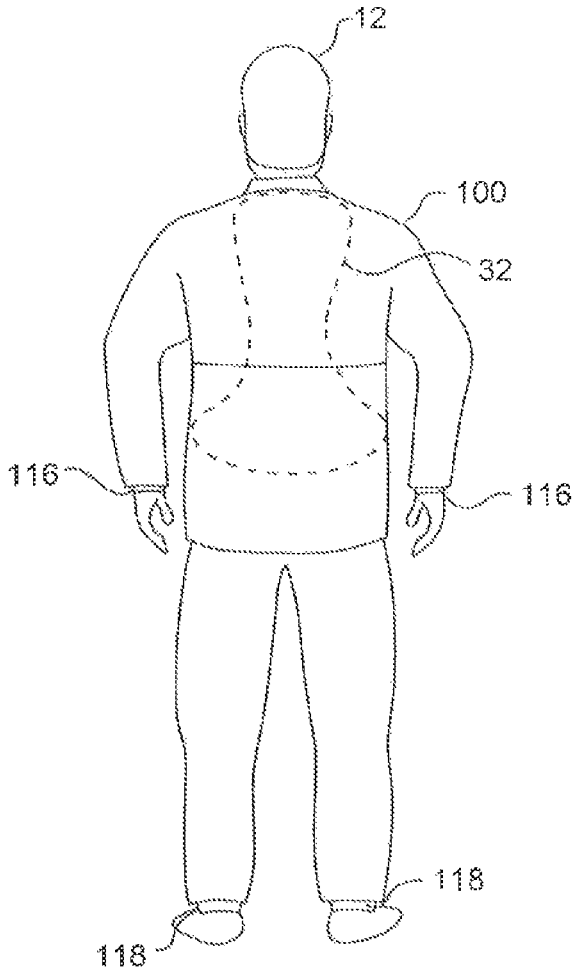
FIG. 12 is a rear elevation view of the second embodiment of outdoor activity suit illustrated in FIG. 11.
Figure 13:
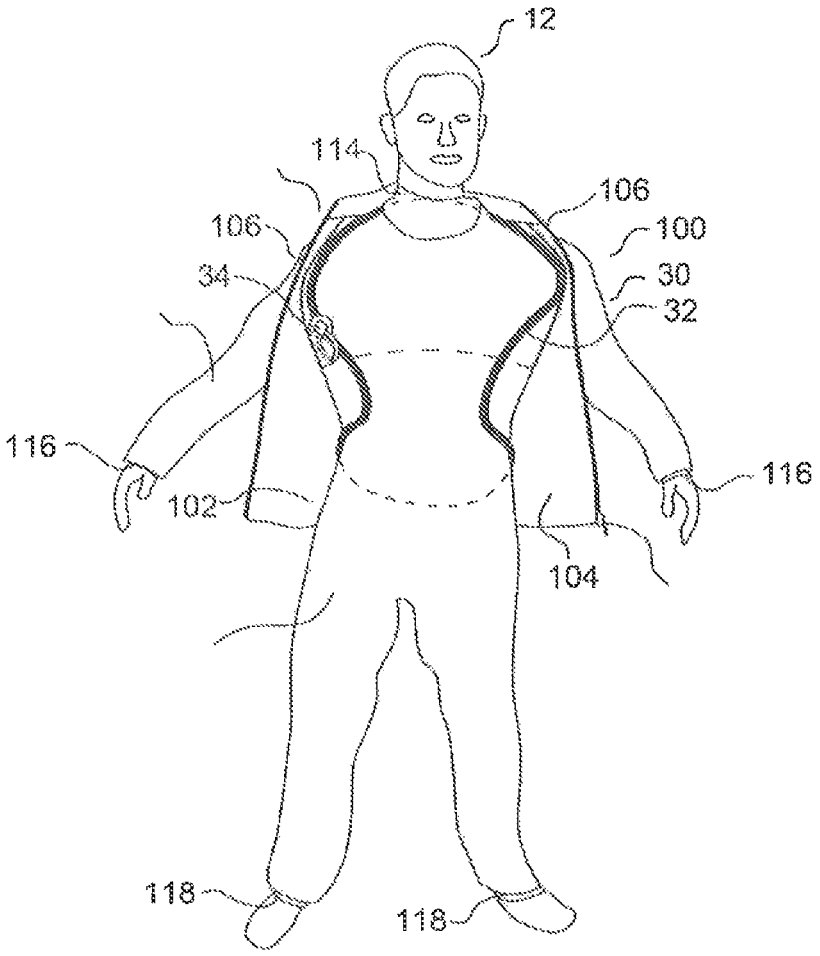
FIG. 13 is a front elevation view of the second embodiment of outdoor activity suit illustrated in FIG. 11, showing jacket zipper open to reveal torso flap detail.
Figure 14:
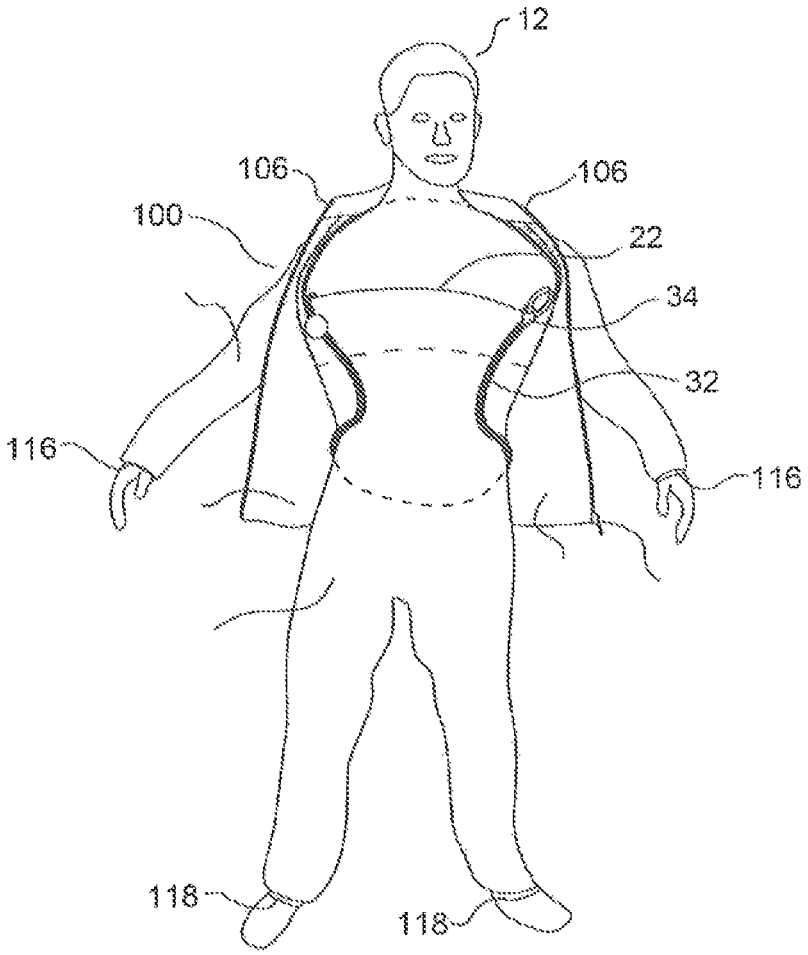
FIG. 14 is a front elevation view of the second embodiment of outdoor activity suit illustrated in FIG. 13, with the neck receiving portion tucked under.
Figure 16:
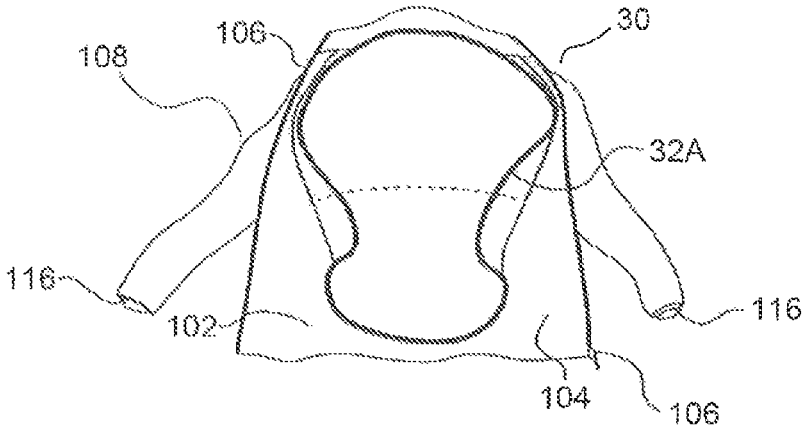
FIG. 16 is a front elevation view of the second component of the second embodiment of outdoor activity suit illustrated in FIG. 11, the second component being separated from the first component for use as a jacket.

Referring to FIG. 13, with outdoor activity suit 100 second component 30 includes wrap around torso flaps 102 and 104. Referring to FIG. 11, when torso flaps 102 and 104 are secured together with a conventional zipper 106, they form an overlying jacket 108. Referring to FIG. 16, when second component 30 is separated from first component 28, second component 30 can function independently as a jacket.

Figure 15:
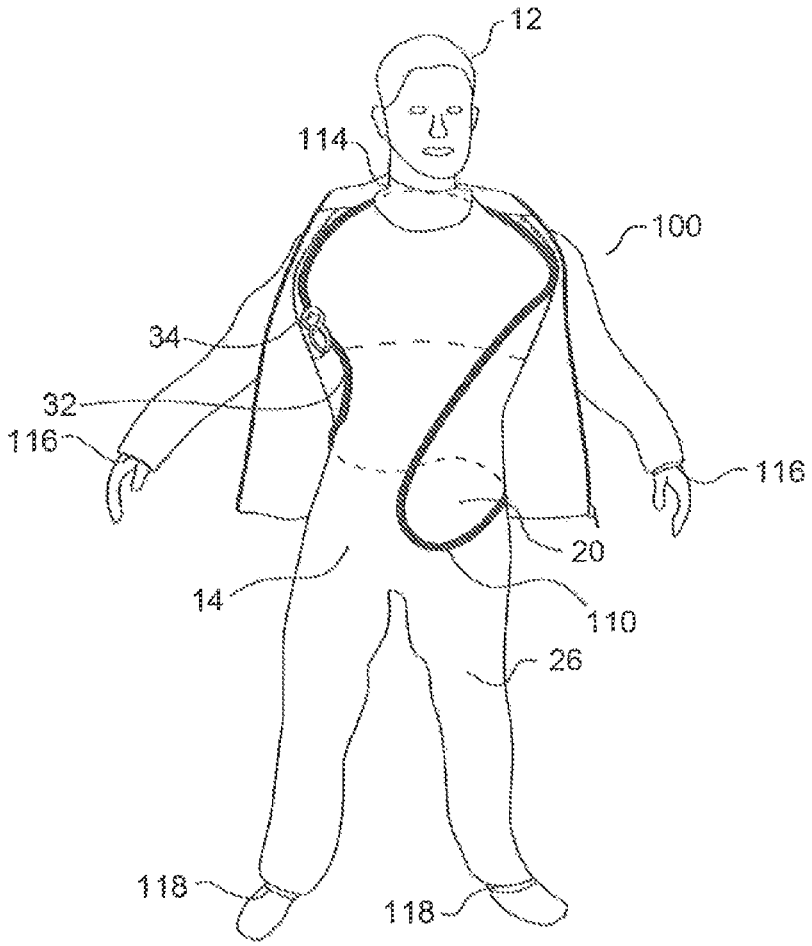
FIG. 15 is a front elevation view of the second embodiment of outdoor activity suit illustrated in FIG. 13, with the endless loop zipper extending down the front portion to the legs receiving portion along one of the opposed sides to provide access to accommodate male urination.

Referring to FIG. 15, there is illustrated an additional feature that could be added to either outdoor activity suit 10 or outdoor activity suit 100. It is illustrated with outdoor activity suit 100, as outdoor activity suit 100 is itself a variation of outdoor activity suit 100. As illustrated, endless loop fastener 32 (zipper) has a portion 110 which extends down front portion 14 of body 12 reaching legs receiving portion 26 along one of opposed sides (side 20 has been illustrated). By using multiple sliders 34 on endless loop fastener 32 (zipper), access can be made to accommodate male urination.

Figure 5:
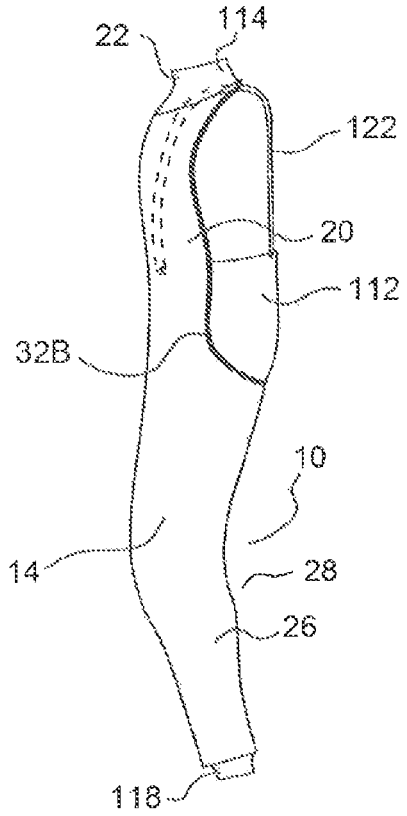
FIG. 5 is a side elevation view of the first embodiment of outdoor activity suit illustrated in FIG. 4, with an added panel to permit use as hip waders.
Figure 6:
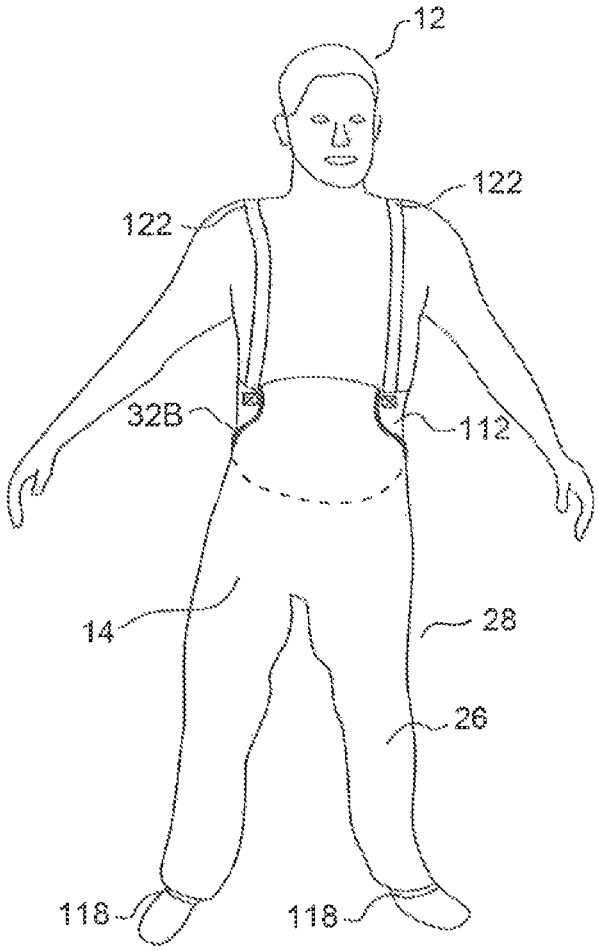
FIG. 6 is a front elevation view of the first embodiment of outdoor activity suit illustrated in FIG. 4, with the neck receiving portion tucked under.

Referring to FIG. 5, there is illustrated an additional feature that was added to outdoor activity suit 10 in order to allow outdoor activity suit 10 to be able to be used as hip waders. First component 28 has a panel 112 that underlies second component 30 adjacent to legs receiving portion 26. When second component 30 is removed, panel 112 increases the depth to which a person wearing the suit may wade in water before water flows into outdoor activity suit 10.

When intended for use as an immersion suit for water sports, outdoor activity suit 10 or 100 can be made with dry suit seals in the regions of the neck, wrists and ankles, identified in the Figures as neck seals 114, wrist seals 116 and ankle seals 118. In addition, when intended as an immersion suit for water sports, outdoor activity suit 10 or 100 can be made with waterproof soft socks 120.

Operation of the First Embodiment 10 and Second Embodiment 100

Figure 4:
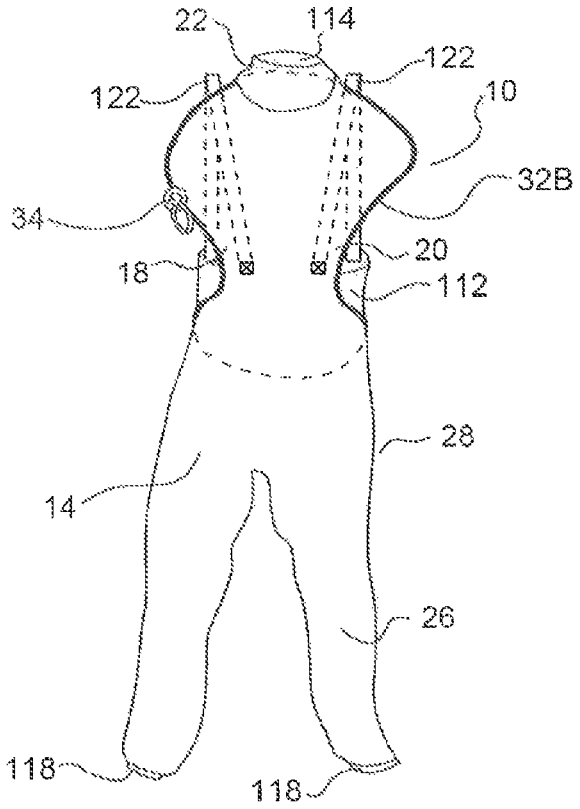
FIG. 4 is a front elevation view of the first component of the first embodiment of outdoor activity suit illustrated in FIG. 1, used with suspenders and with neck receiving portion in position.
Figure 7:
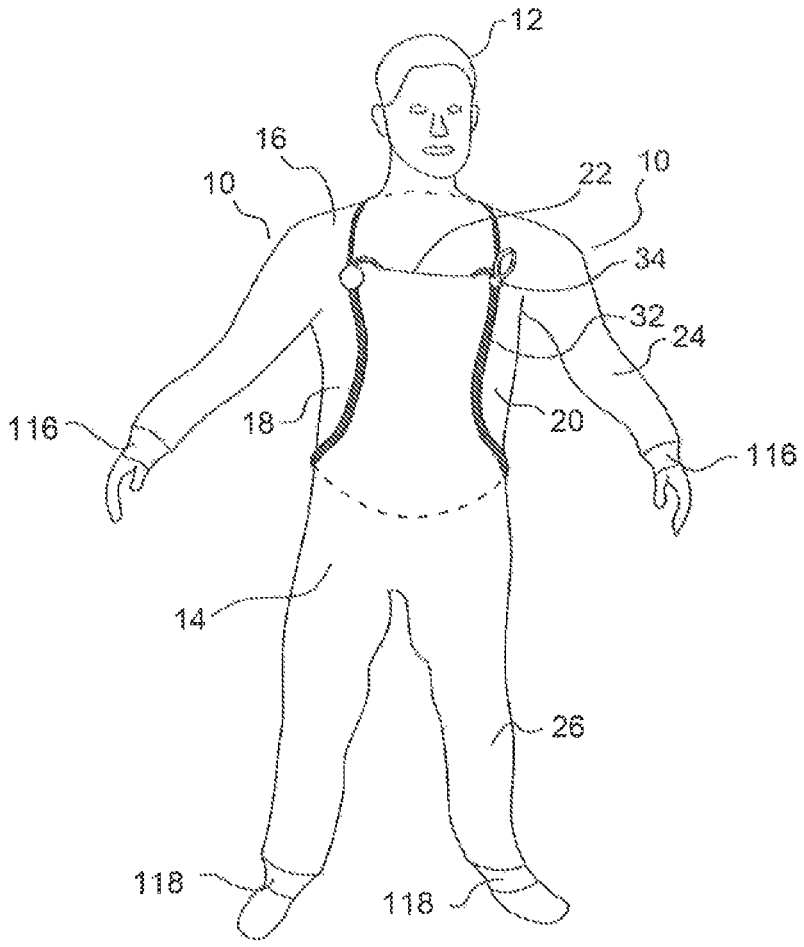
FIG. 7 is a front elevation view of the first embodiment of outdoor activity suit illustrated in FIG. 1, with the neck receiving portion tucked under.
Figure 8:
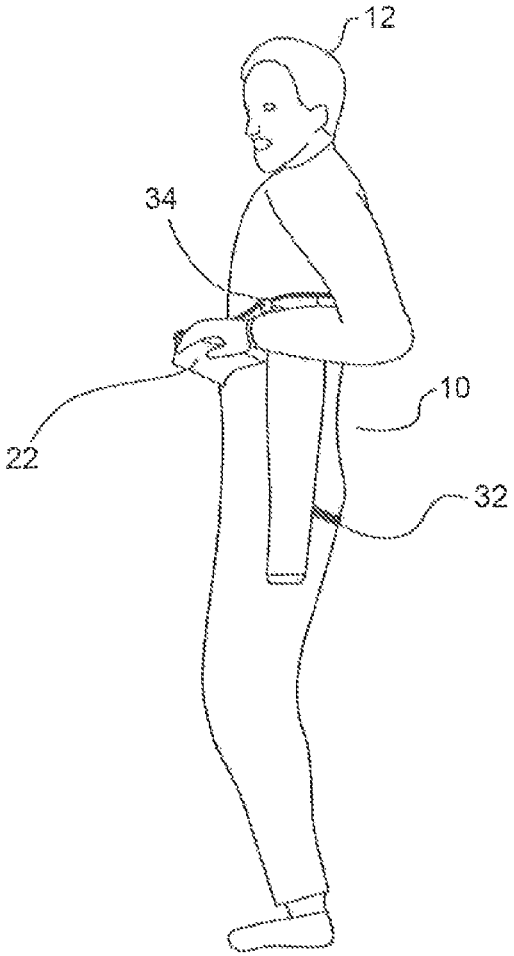
FIG. 8 is a side elevation view of the first embodiment of outdoor activity suit illustrated in FIG. 1, with a person attempting a top entry.
Figure 9:
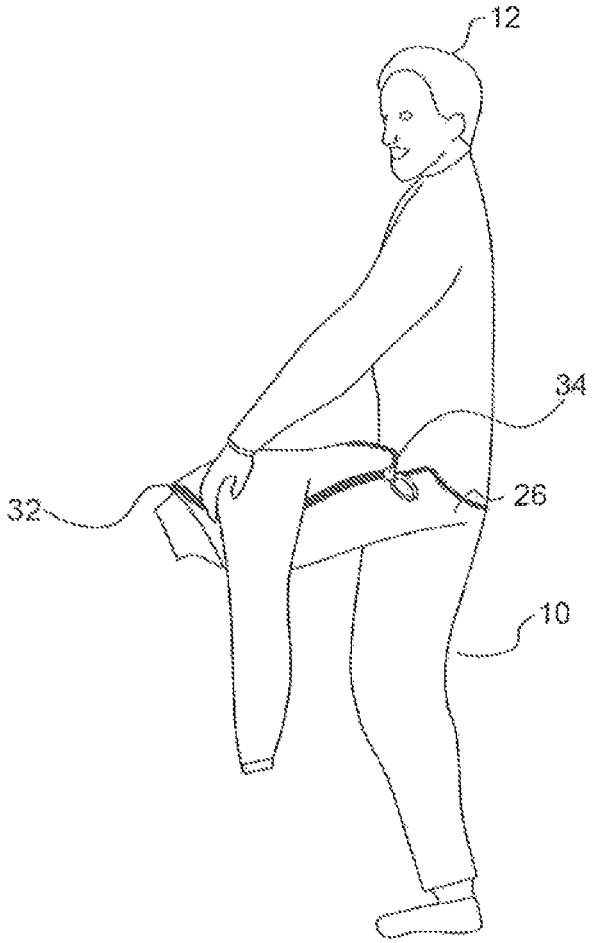
FIG. 9 is a side elevation view of the first embodiment of outdoor activity suit illustrated in FIG. 1, with a person attempting a bottom entry.
Figure 10:
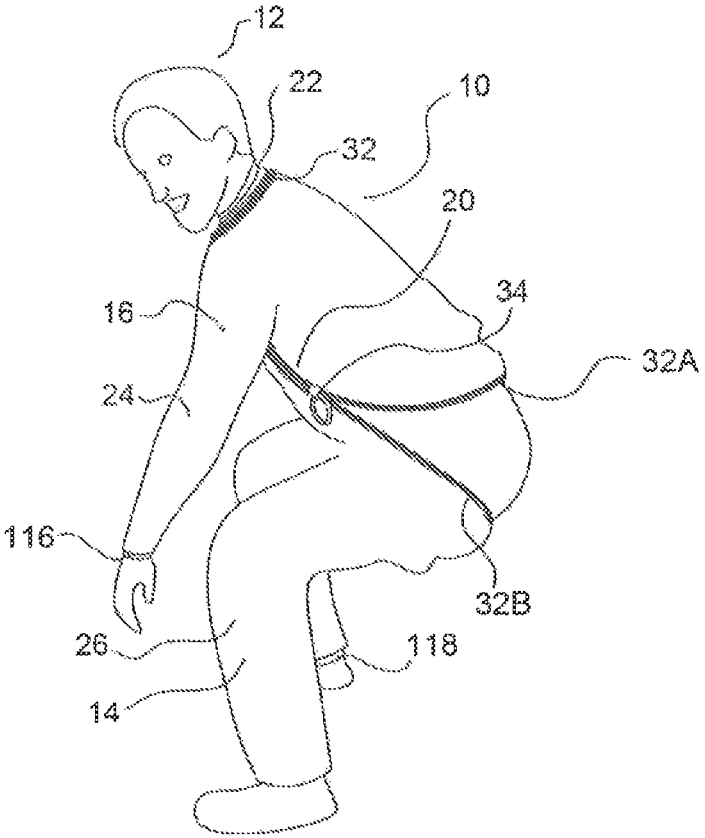
FIG. 10 is a side elevation view of the first embodiment of outdoor activity suit illustrated in FIG. 1, with a person preparing to defecate.

Outdoor activity suits 10 and 100, as described above, are extremely versatile. Referring to FIG. 3, a person wearing outdoor activity suit 10 or 100, can separate the second component as shown in FIG. 3 to provide relief from the heat and wear only the first component, as shown in FIG. 4 and FIG. 5. Referring to FIG. 8, there is illustrated how outdoor activity suit 10 can be donned by using multiple sliders 34 and opening endless loop fastener 32 in the vicinity of neck receiving portion 22 for a top entry. Referring to FIG. 9, there is illustrated how outdoor activity suit 10 can be donned by using multiple sliders 34 and opening endless loop fastener 32 in the vicinity of legs receiving portion 26 for a bottom entry. Referring to FIG. 10, there is illustrated how a person wearing outdoor activity suit 10 can use multiple sliders 34 and open endless loop fasteners 32 in the vicinity of legs receiving portion 26 in order to defecate. Referring to FIG. 15, there is illustrated how providing endless loop fastener 32 (zipper) with a portion 112 which extends down front portion 14 if body 12 reaching legs receiving portion 26 along one of opposed sides (side 20 has been illustrated) and by using multiple sliders 34 on endless loop fastener 32 (zipper), access can be made to accommodate male urination Referring to FIG. 6, there is illustrated how a person wearing outdoor activity suit 10 can separate the second component as shown in FIG. 3 to provide relief from the heat and wear only first component 28, with neck receiving portion 22 folded down. With this configuration, it is preferred that suspenders 122 be used. Referring to FIG. 7 with respect to outdoor activity suit 10 and FIG. 14 with respect to outdoor activity suit 100, there is illustrated how, without separating first component 28 and second component 30, a person wearing one of the outdoor activity suits can use multiple sliders 34 to release neck receiving portion 22 and then fold head receiving portion 22 under. This configuration is particularly relevant to water sport applications in which there is a neck seal. Referring to FIG. 16, there is illustrated how the addition of torso flaps 102 and 104 with a conventional zipper 106, enables second component 30 to function independently as a jacket 108 when separated form first component 28.

Further Variations

Figure 17:
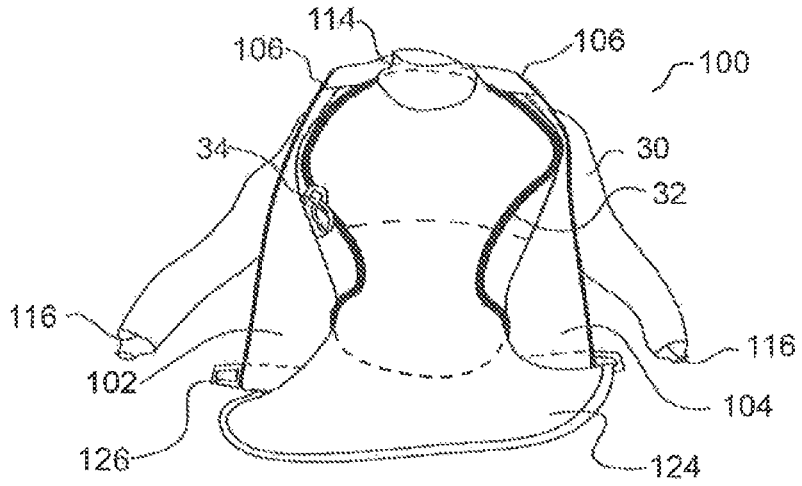
FIG. 17 is a front elevation view of a variation of the second component of the outdoor activity suit, which has modified for kayaking by the addition of a dry-skirt and waist belt.

Referring to FIG. 17 there is illustrated second component 30, which has modified for kayaking by the addition of a dry-skirt 124 and waist belt 126.

Figure 18:
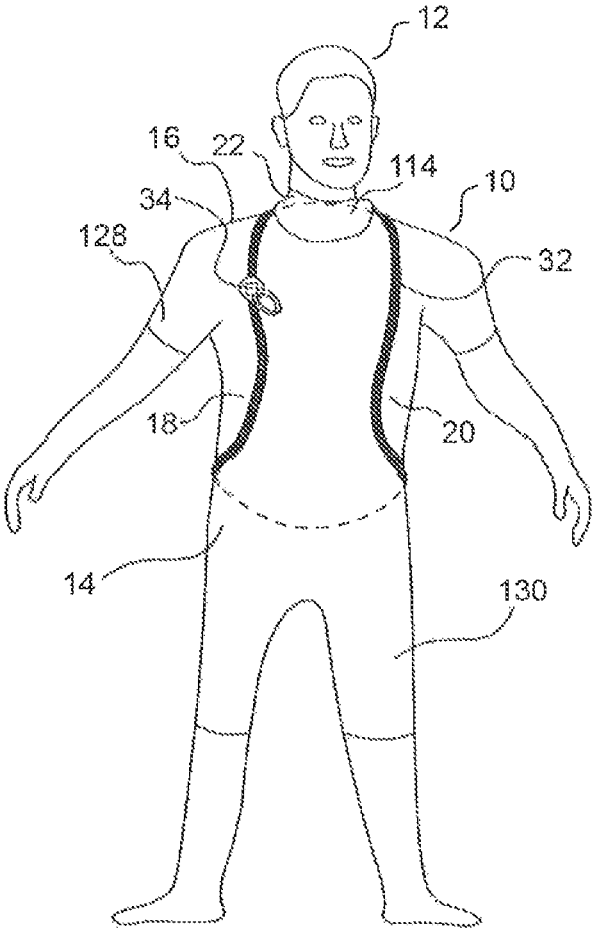
FIG. 18 is a front elevation view of a variation of the outdoor activity suit, which has short leg receiving portions and short arm receiving portions.

Referring to FIG. 18 there is illustrated a variation of the outdoor activity suit, which has leg receiving portions 130 shortened and arm receiving portions 128 shortened. As "short" is relative term, it is envisaged that the shortened leg receiving portions 130 will not cover a calf of a wearer and the shortened arm receiving portions 128 will not cover a forearm of the wearer.

Figure 19:
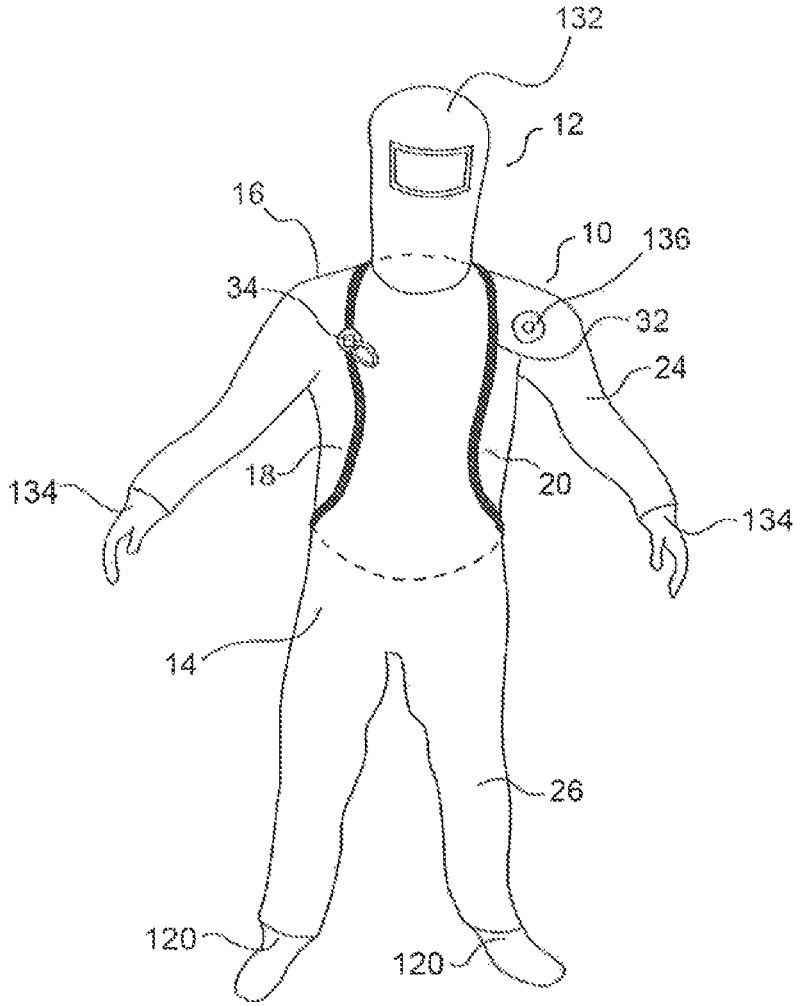
FIG. 19 is a front elevation view of a variation of the outdoor activity suit, which has been modified for use as a hazardous materials suit by the addition of socks, gloves, a sealed hood and a valve for pressurization.

Referring to FIG. 19 there is illustrated a variation of the outdoor activity suit, which has been modified for use as a hazardous materials suit by the addition of socks 120, gloves 134, a sealed hood 132 and a valve 136. Valve 136 is used to pressurize the outdoor activity suit to maintain positive air pressure which serves as a pressurization barrier against the entry of contaminants.

Figure 20:
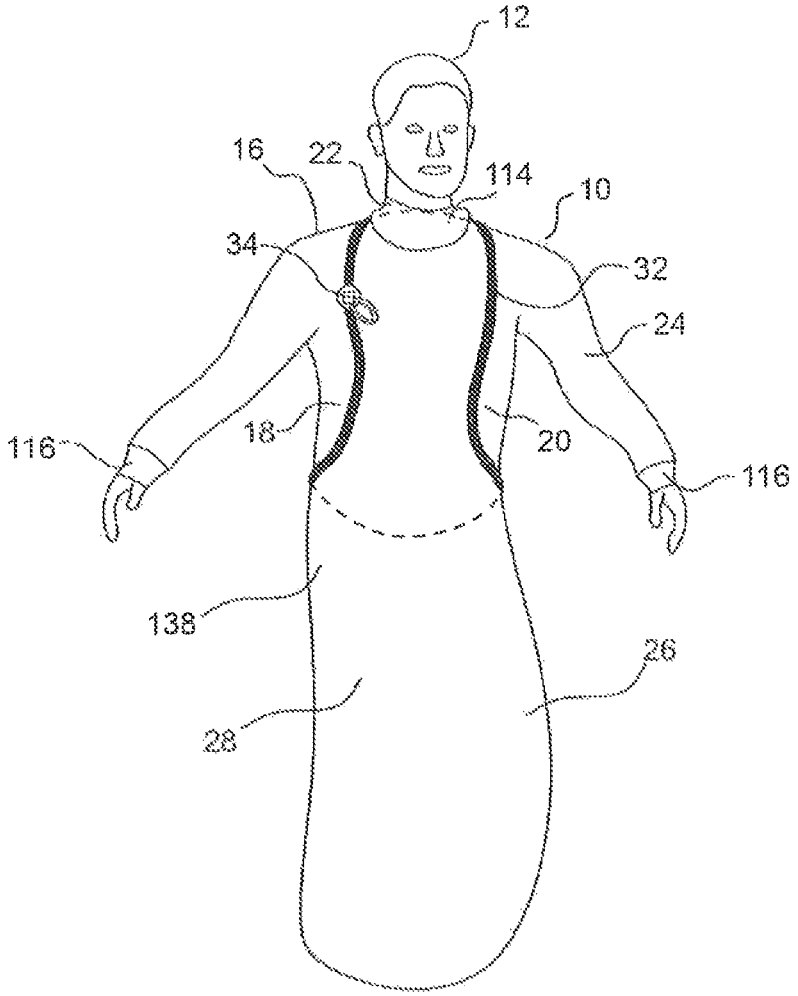
FIG. 20 is a front elevation view of a variation of the outdoor activity suit, which has been modified with the legs receiving portion of the first component of the body forming a sleeping bag.

Referring to FIG. 20 there is illustrated a variation of the outdoor activity suit, which has been modified with legs receiving portion 26 of first component 28 forms a sack 138. It is envisaged that this alternative version of first component 28 can be attached at night and used as a sleeping bag.

Figure 21:
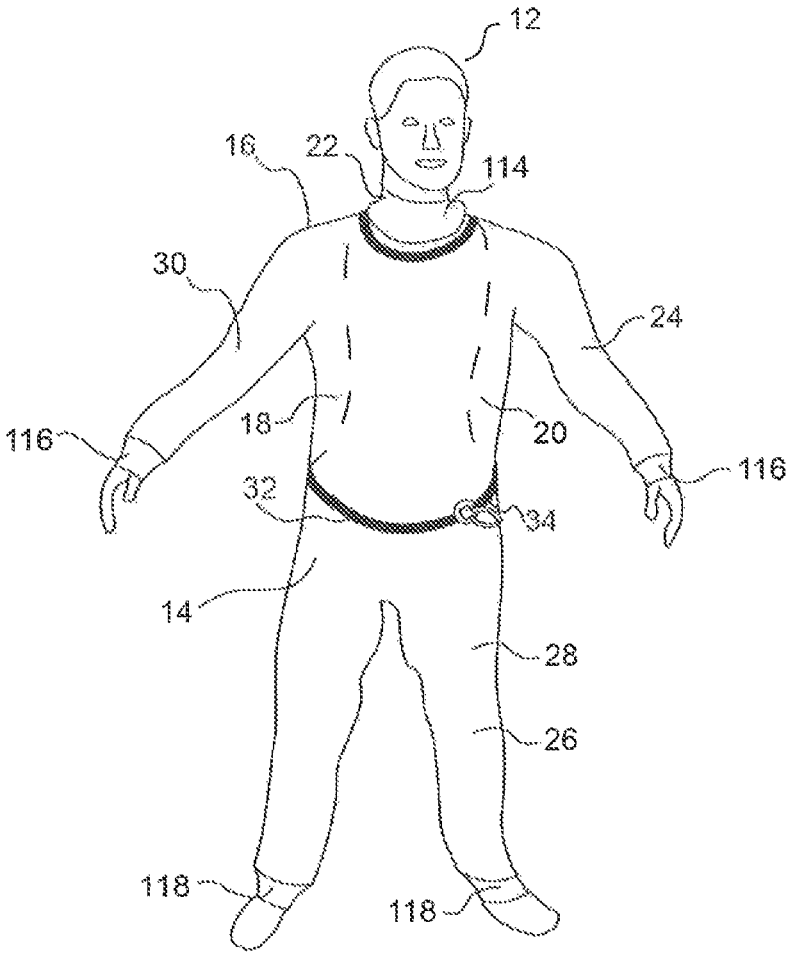
FIG. 21 is a front elevation view of a variation of the outdoor activity suit with the positioning of the endless loop fastener reversed from front to back.

Referring to FIG. 21, there is illustrated a variation of the outdoor activity suit in which the positioning of the endless loop fastener 32 connecting first component 28 and second component 30 is reversed. In this regard, endless loop fastener is positioned across front portion 14 of body 12 adjacent to neck receiving portion 22. Endless loop fastener 32 then extends down opposed sides 18 and 20 of body 12 along rear portion 16. Endless loop fastener 32 finally extends across front portion 14 adjacent to leg receiving portion 26.

It will be apparent that outdoor activity suit 10 and outdoor activity suit 100 can be made from different materials depending upon the intended use. Those materials may be breathable or non-breathable. Those materials may be stretchable or non-stretchable. Those materials may be waterproof or non-waterproof. Those materials may be woven or non-woven. It will also be apparent that first component 28 and second component 30 need not be made from the same materials. It will also be apparent that outdoor activity suit 10 and outdoor activity suit 100 can be tight fitting or loose fitting. In this regard, one of first component 28 or second component 30 can be tight fitting, while the other of first component 28 and second component 30 are loose fitting.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An outdoor activity suit comprising:

a body having a front portion, a back portion, opposed sides where the front portion connects to the back portion, a neck receiving portion defining a neck opening, an arms receiving portion and a legs receiving portion;

the front portion, the neck receiving portion and the legs receiving portion of the body forming a first component of the body;

the back portion and the arms receiving portion forming a second component of the body; and an endless loop fastener connecting the first component and the second component, the endless loop fastener extending across the back portion adjacent to the neck receiving portion, down the front portion of the body adjacent to each of the opposed sides and across the back portion adjacent to the legs receiving portion, such that the second component is selectively removable from the first component allowing the first component to be worn independent from the second component.

2. The outdoor activity suit according to claim 1, wherein the endless loop fastener is a dry zipper.

3. The outdoor activity suit according to claim 1, wherein the endless loop fastener has multiple sliders to facilitate opening selected portions of the endless loop fastener.

4. The outdoor activity suit according to claim 1, wherein the second component includes wrap around torso flaps which create an overlying jacket, and enabling the second component to be worn as a jacket independent from the first component.

5. The outdoor activity suit according to claim 1, wherein the first component has a panel that underlies the second component adjacent to the legs receiving portion.

6. The outdoor activity suit according to claim 1, wherein the second component has a kayaking dryskirt and waist belt.

7. The outdoor activity suit according to claim 1, wherein the legs receiving portions terminate above a calf of a wearer and the arm receiving portions terminate above a forearm of the wearer.

8. The outdoor activity suit according to claim 1, wherein the body is enclosed by the addition of socks, gloves and sealed hood, and the body has a valve for pressurization of the outdoor activity suit.

9. The outdoor activity suit according to claim 1, wherein the legs receiving portion of the first component forms a sack.

10. An outdoor activity suit comprising:

a body having a front portion, a back portion, opposed sides where the front portion connects to the back portion, a neck receiving portion defining a neck opening, an arms receiving portion and a legs receiving portion;

the front portion, the neck receiving portion and the legs receiving portion of the body forming a first component of the body;

the back portion and the arms receiving portion forming a second component of the body which is completely separable from the first component and the second component with one another to form the outdoor activity suit, the endless loop fastener extending across the back portion adjacent to the neck receiving portion, down the front portion of the body adjacent to each of the opposed sides and across the back portion adjacent to the legs receiving portion, such that the second component is selectively removable from the first component allowing the first component to be worn independent from the second component.

* * * * *